US008283582B2

(12) United States Patent
Chen

(10) Patent No.: US 8,283,582 B2
(45) Date of Patent: Oct. 9, 2012

(54) DEFLECTION WEB FOR A KEYPAD ASSEMBLY

(75) Inventor: Chao Chen, Waterloo (CA)

(73) Assignee: Research In Motion Limited, Waterloo, Ontario (CA)

( * ) Notice: Subject to any disclaimer, the term of this patent is extended or adjusted under 35 U.S.C. 154(b) by 240 days.

(21) Appl. No.: 12/826,859

(22) Filed: Jun. 30, 2010

(65) Prior Publication Data

US 2012/0000759 A1 Jan. 5, 2012

(51) Int. Cl.
*H01H 9/26* (2006.01)

(52) U.S. Cl. ..... 200/5 A

(58) Field of Classification Search ..... 200/5 A, 200/5 R, 159 B, 293, 294, 295, 296, 302, 200/340, 243, 310–314, 341–345, 512–520
See application file for complete search history.

(56) References Cited

U.S. PATENT DOCUMENTS

| | | | | |
|---|---|---|---|---|
| 4,555,600 | A | 11/1985 | Morse | |
| 4,716,262 | A | 12/1987 | Morse | |
| 4,839,474 | A * | 6/1989 | Hayes-Pankhurst et al. | 200/5 A |
| 5,517,015 | A | 5/1996 | Curry et al. | |
| 5,568,367 | A | 10/1996 | Park | |
| 5,612,692 | A * | 3/1997 | Dugas et al. | 341/22 |
| 5,704,467 | A * | 1/1998 | Jarvis | 200/302.2 |
| 6,180,895 | B1 * | 1/2001 | Hutchinson et al. | 200/5 A |
| 6,462,294 | B2 * | 10/2002 | Davidson et al. | 200/512 |
| 6,611,738 | B2 | 8/2003 | Ruffner | |
| 6,743,993 | B1 * | 6/2004 | Clark et al. | 200/314 |
| 7,236,271 | B2 | 6/2007 | Silverbrook | |
| 7,313,467 | B2 | 12/2007 | Breed et al. | |
| 7,444,210 | B2 | 10/2008 | Breed et al. | |
| 7,456,994 | B2 | 11/2008 | Silverbrook et al. | |
| 7,466,444 | B2 | 12/2008 | Silverbrook et al. | |
| 7,628,467 | B2 | 12/2009 | Silverbrook | |
| 2008/0019115 | A1 | 1/2008 | Park et al. | |
| 2009/0107816 | A1 * | 4/2009 | Chen et al. | 200/314 |
| 2011/0073456 | A1 * | 3/2011 | Chen | 200/5 A |

FOREIGN PATENT DOCUMENTS

EP 1391905 A1 2/2004

(Continued)

OTHER PUBLICATIONS

John Murray et al., "Enhanced Elastomeric Keypad/Bezel Structure Arrangement for Keypad Size Optimization" Motorola, Inc., Technical Developments, Original Publication date: May 1, 1996, p. 101; IP.com Electronic Publication, PriorArtDatabase: Apr. 15, 2001, available: http://www.ip.com/pubview/IPCOM000007682D.

(Continued)

*Primary Examiner* — Edwin A. Leon
(74) *Attorney, Agent, or Firm* — Bereskin & Parr LLP/S.E.N.C.R.L., s.r.l.

(57) ABSTRACT

A deflection web is provided for use in a keypad assembly. The deflection web comprises a plurality of actuators resiliently coupled together by a flexible membrane. Each actuator of the deflection web corresponds to a key of the keypad assembly, and for each actuator, the flexible membrane comprises a corresponding radially outwardly extending flange whose thickness varies in a direction from the corresponding actuator. In some instances, the thickness of the flange may increase as the flange extends a distance radially outward from its corresponding actuator. A method for creating the deflection web of the keypad assembly and a method for assembling the keypad assembly are also provided.

20 Claims, 12 Drawing Sheets

FOREIGN PATENT DOCUMENTS

WO 2004/088694 A1 10/2004

OTHER PUBLICATIONS

Web page. Wikipedia, "Silicone Rubber Keypad", available: http://en.wikipedia.org/wiki/Silicone_rubber_keypad.

Web page. Top Bound USA, "In Mold (IMF) Keypad Artwork", available: http://topboundusa.com/keypads.html.

European Search and Examination Report (Application No. EP 10167824.1), dated Dec. 20, 2010.

* cited by examiner

DEFLECTION WEB FOR A KEYPAD ASSEMBLY

RELEVANT FIELD

The field of the disclosure relates generally to keypads and keypad assemblies, with particular but by no means exclusive application to keypads of mobile communications devices.

BACKGROUND

Keypad assemblies used in electronic devices such as mobile communications devices may incorporate deflection webs. Deflection webs are typically flexible membranes interposed between the keys of a keypad and an underlying printed circuit board (PCB) containing switches which may be activated upon depression of the corresponding key(s). Deflection webs provide some protection against water and other contaminants interfering with the operation of the PCB. As well, deflection webs may be used as positioning and depression guides for the keys of the keypad assembly.

BRIEF DESCRIPTION OF THE DRAWINGS

Embodiments are described in further detail below, by way of example only, with reference to the accompanying drawings, in which.

DETAILED DESCRIPTION

Figure 1:
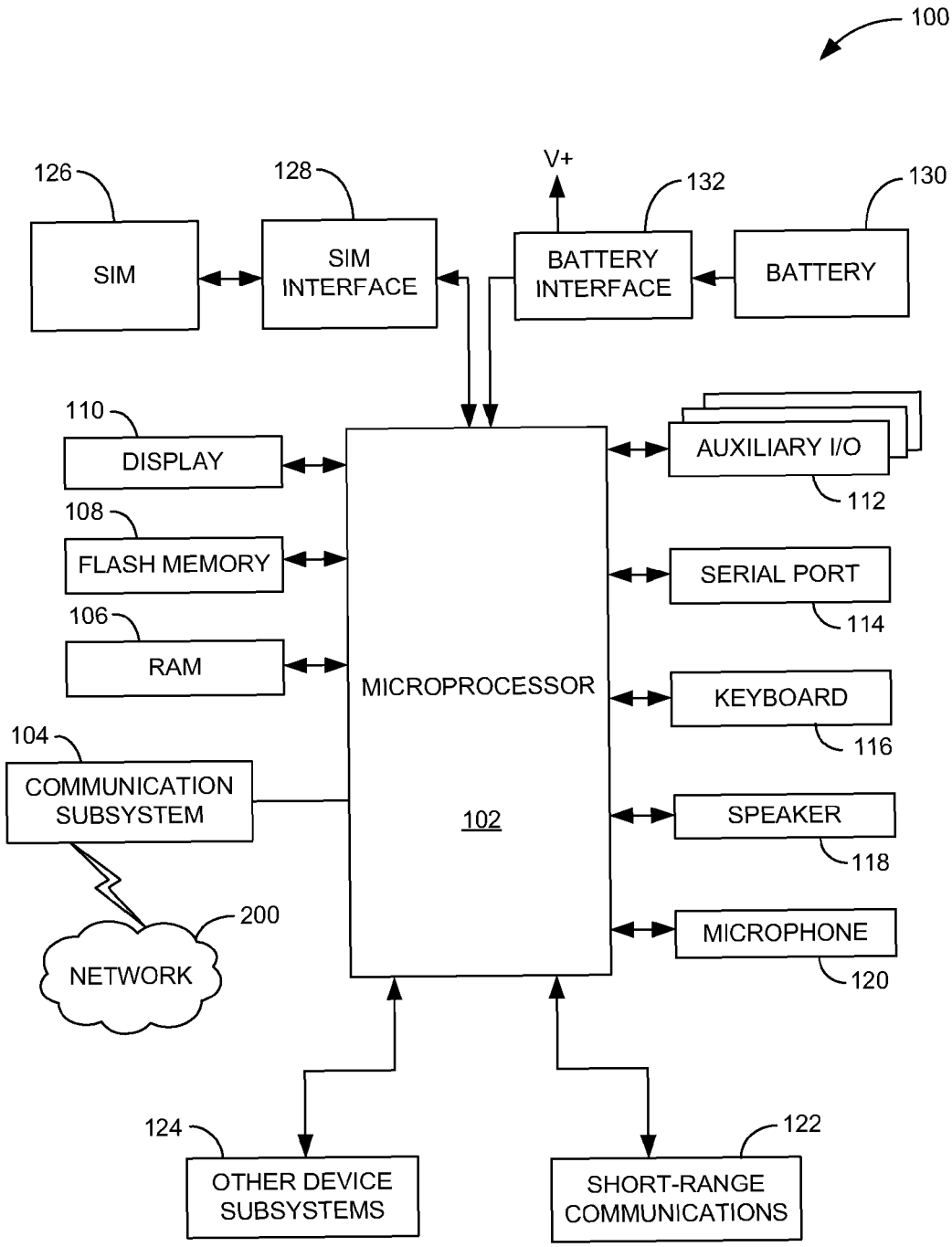
FIG. 1 is a block diagram of a mobile device in one example implementation.

In one broad aspect, there is provided a keypad assembly. The keypad assembly includes a plurality of keys; and a deflection web comprising a plurality of actuators resiliently coupled together by a flexible membrane. Each actuator corresponds to a key, and for each actuator, the flexible membrane comprises a corresponding radially outwardly extending flange whose thickness varies in a direction from the corresponding actuator. In some instances, the thickness of the flange may increase as the flange extends in the direction from the corresponding actuator.

In some embodiments, the upper and lower surfaces of the flange are non-parallel. Each actuator may comprise a seat for receiving a key. The keypad assembly may include a keypad base having a plurality of switches, each switch corresponding to one of the plurality of keys. Further, the keypad base may have an overlay superimposed thereon, with a dome corresponding to, and covering, each switch. The height of each dome may be approximately equal to the displacement of the corresponding actuator required to cause an upper surface of the corresponding flange to lie substantially orthogonal to said displacement.

The deflection web may be provided between the plurality of keys and the keypad base, and in some embodiments, the deflection web may be anchored to the keypad base. When a key is in a first undepressed position, the corresponding actuator may be displaced by the height of the corresponding dome. Further, this may cause an upper surface of the corresponding flange to lie substantially flat proximate the corresponding actuator.

In some embodiments, when each key is in a first undepressed position, the upper surface of the flexible membrane may be substantially planar. Further, when each key is in a first undepressed position, for each actuator, the corresponding flange may exert a pre-load force on the actuator and a component of the pre-load force may be exerted in a downward direction.

In other embodiments, the keypad assembly may further comprise a light shielding layer provided between the plurality of keys and the deflection web. A maximum downward displacement of each key may be approximately equal to a displacement required to activate the corresponding switch. In another embodiment, the keypad assembly is configured for use in a mobile device. In yet another embodiment, a mobile device comprising the keypad assembly is provided.

In another broad aspect, a deflection web for a keypad assembly is provided. The deflection web includes a plurality of actuators; and a flexible membrane resiliently coupling each of the actuators together. For each actuator, the flexible membrane comprises a corresponding radially outwardly extending flange and the thickness of the flange varies in a direction from the corresponding actuator.

In some embodiments, when each actuator is depressed, the corresponding flange exerts a force on the actuator to counteract the depression. A chamfer may be provided at the intersection of each flange and corresponding actuator. Further, the flexible membrane may comprise an elastomeric material. Each actuator may be configured to receive a key of a keypad assembly, and the deflection web may be configured for anchoring to a keypad base.

In other embodiments, when the deflection web is anchored to a keypad base, each actuator is depressible from a first undepressed position wherein the flexible membrane is substantially planar.

In another broad aspect, a method for creating a deflection web for a keypad assembly is provided. The method includes providing a plurality of actuators in a substantially planar configuration; and providing a flexible membrane resiliently coupling the plurality of actuators together. For each actuator, the flexible membrane comprises a corresponding radially outwardly extending flange, and the thickness of the flange varies in a direction from the corresponding actuator. In some embodiments, a portion of the deflection web may be co-molded to frame. The frame may be made of hard plastic and may be injection molded. In some embodiments, the flexible membrane comprises an elastomeric material.

In another broad aspect, a method for assembling a keypad assembly is provided. The method includes providing a deflection web having a plurality of actuators resiliently coupled together with a flexible membrane. For each actuator, the flexible membrane comprises a corresponding radially outwardly extending flange with a thickness that varies in a direction from the actuator. The method further includes anchoring the deflection web to a keypad base such that a pre-load force is generated in each flange; providing a plurality of keys, each key configured to sit within an actuator of the deflection web; and positioning the plurality of keys such that each actuator is seated within an actuator of the deflection web.

In yet another broad aspect, there is provided a deflection web for a keypad assembly. The deflection web includes an actuator; and a flange extending radially outwardly from the actuator. The thickness of the flange varies in a direction from the actuator. In some embodiments, the actuator may be configured to receive a key.

Some embodiments of the system and methods described herein make reference to a mobile device. A mobile device may be a two-way communication device with advanced data communication capabilities having the capability to communicate with other computer systems. A mobile device may also include the capability for voice communications. Depending on the functionality provided by a mobile device, it may be referred to as a data messaging device, a two-way pager, a cellular telephone with data messaging capabilities, a wireless Internet appliance, or a data communication device (with or without telephony capabilities), for example. A mobile device may communicate with other devices through a network of transceiver stations.

Figure 2:
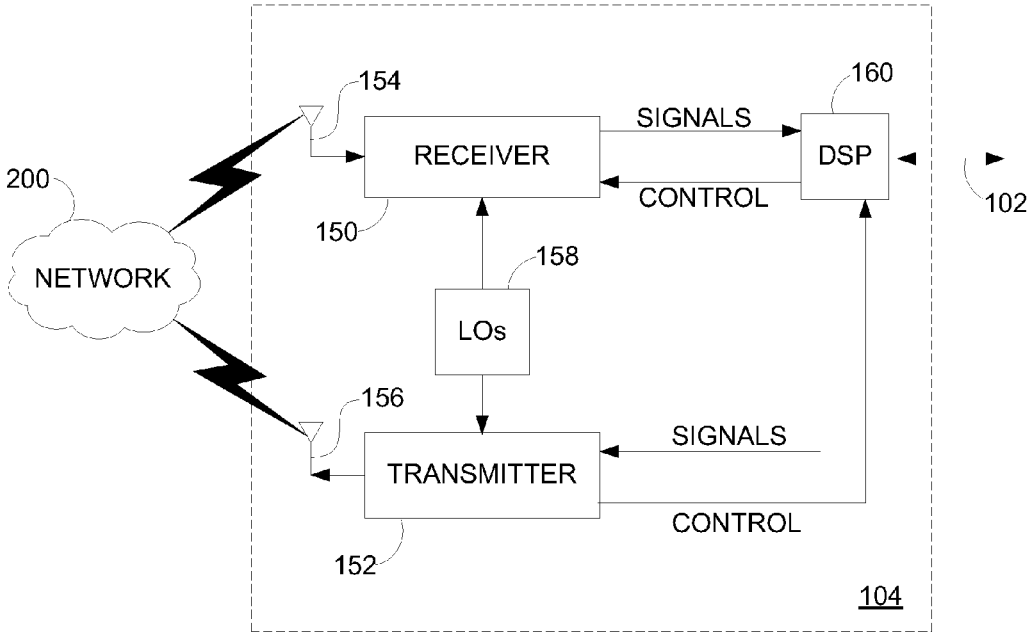
FIG. 2 is a block diagram of a communication subsystem component of the mobile device of FIG. 1.
Figure 3:
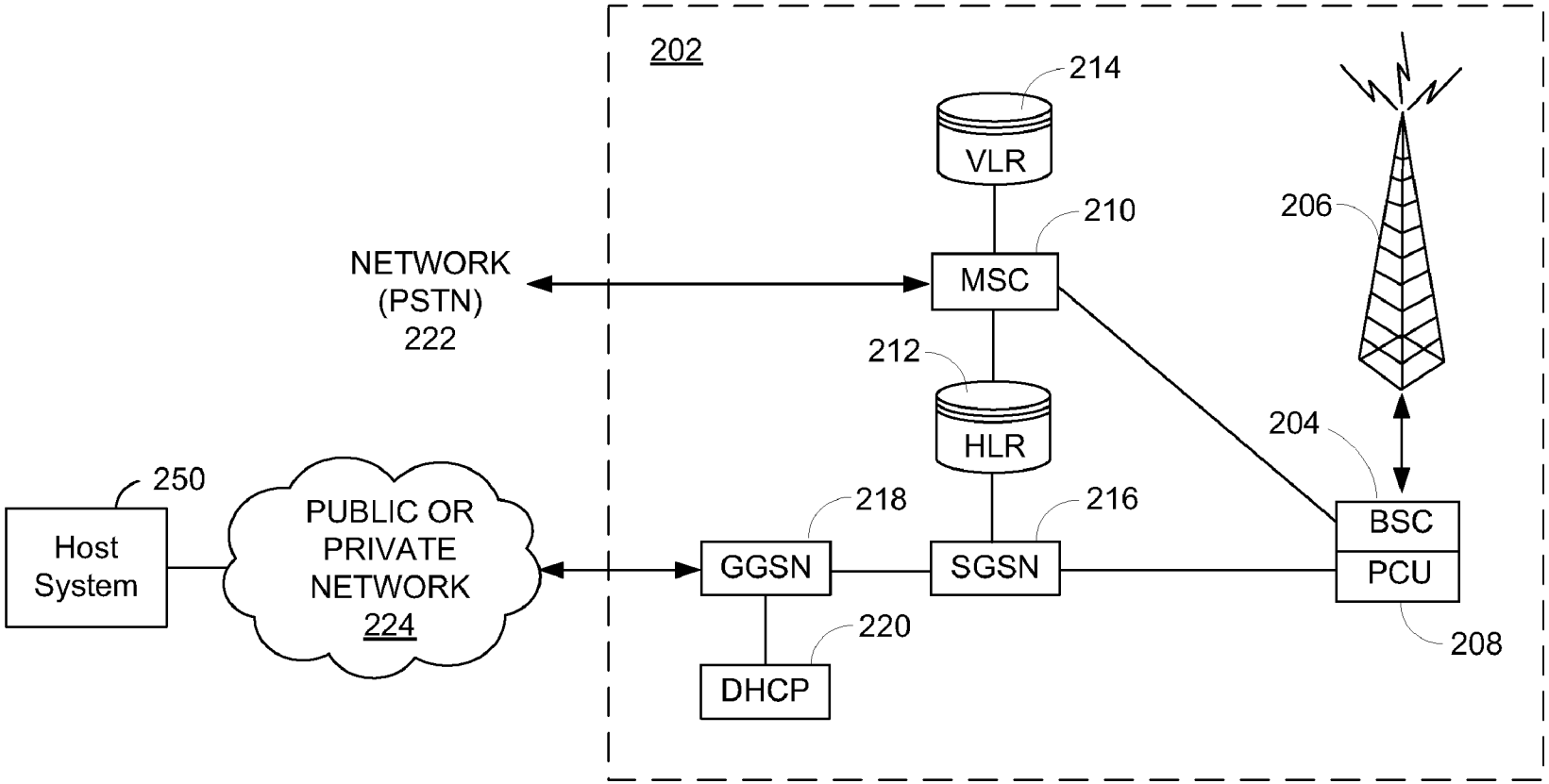
FIG. 3 is a block diagram of a node of a wireless network.

To aid the reader in understanding the structure of a mobile device and how it communicates with other devices, reference is made to FIGS. 1 through 3.

Referring first to FIG. 1, a block diagram of a mobile device in one example implementation is shown generally as 100. Mobile device 100 comprises a number of components, the controlling component being microprocessor 102. Microprocessor 102 controls the overall operation of mobile device 100. Communication functions, including data and voice communications, may be performed through communication subsystem 104. Communication subsystem 104 may be configured to receive messages from and send messages to a wireless network 200. In one example implementation of mobile device 100, communication subsystem 104 may be configured in accordance with the Global System for Mobile Communication (GSM) and General Packet Radio Services (GPRS) standards. The GSM/GPRS wireless network is used worldwide and it is expected that these standards may be supplemented or superseded eventually by Enhanced Data GSM Environment (EDGE) and Universal Mobile Telecommunications Service (UMTS), and Ultra Mobile Broadband (UMB), etc. New standards are still being defined, but it is believed that they will have similarities to the network behaviour described herein, and it will also be understood by persons skilled in the art that the embodiments of the present disclosure are intended to use any other suitable standards that are developed in the future. The wireless link connecting communication subsystem 104 with network 200 represents one or more different Radio Frequency (RF) channels, operating according to defined protocols specified for GSM/GPRS communications. With newer network protocols, these channels are capable of supporting both circuit switched voice communications and packet switched data communications.

Although the wireless network associated with mobile device 100 is a GSM/GPRS wireless network in one example implementation of mobile device 100, other wireless networks may also be associated with mobile device 100 in variant implementations. Different types of wireless networks that may be employed include, for example, data-centric wireless networks, voice-centric wireless networks, and dual-mode networks that can support both voice and data communications over the same physical base stations. Combined dual-mode networks include, but are not limited to, Code Division Multiple Access (CDMA) or CDMA2000 networks, GSM/GPRS networks (as mentioned above), and future third-generation (3G) networks like EDGE and UMTS. Some older examples of data-centric networks include the Mobitex™ Radio Network and the DataTAC™ Radio Network. Examples of older voice-centric data networks include Personal Communication Systems (PCS) networks like GSM and Time Division Multiple Access (TDMA) systems. Other network communication technologies that may be employed include, for example, Integrated Digital Enhanced Network (iDEN™), Evolution-Data Optimized (EV-DO), and High Speed Packet Access (HSPA), etc.

Microprocessor 102 may also interact with additional subsystems such as a Random Access Memory (RAM) 106, flash memory 108, display 110, auxiliary input/output (I/O) subsystem 112, serial port 114, keyboard 116, speaker 118, microphone 120, short-range communications subsystem 122 and other device subsystems 124.

Some of the subsystems of mobile device 100 perform communication-related functions, whereas other subsystems may provide "resident" or on-device functions. By way of example, display 110 and keyboard 116 may be used for both communication-related functions, such as entering a text message for transmission over network 200, as well as device-resident functions such as a calculator or task list. Operating system software used by microprocessor 102 is typically stored in a persistent store such as flash memory 108, which may alternatively be a read-only memory (ROM) or similar storage element (not shown). Those skilled in the art will appreciate that the operating system, specific device applications, or parts thereof, may be temporarily loaded into a volatile store such as RAM 106.

Mobile device 100 may send and receive communication signals over network 200 after network registration or activation procedures have been completed. Network access may be associated with a subscriber or user of a mobile device 100. To identify a subscriber, mobile device 100 may provide for a Subscriber Identity Module ("SIM") card 126 to be inserted in a SIM interface 128 in order to communicate with a network. SIM 126 may be one example type of a conventional "smart card" used to identify a subscriber of mobile device 100 and to personalize the mobile device 100, among other things. Without SIM 126, mobile device 100 may not be fully operational for communication with network 200. By inserting SIM 126 into SIM interface 128, a subscriber may access all subscribed services. Services may include, without limitation: web browsing and messaging such as e-mail, voice mail, Short Message Service (SMS), and Multimedia Messaging Services (MMS). More advanced services may include, without limitation: point of sale, field service and sales force automation. SIM 126 may include a processor and memory for storing information. Once SIM 126 is inserted in SIM interface 128, it may be coupled to microprocessor 102. In order to identify the subscriber, SIM 126 may contain some user parameters such as an International Mobile Subscriber Identity (IMSI). By using SIM 126, a subscriber may not necessarily be bound by any single physical mobile device. SIM 126 may store additional subscriber information for a mobile device as well, including datebook (or calendar) information and recent call information.

Mobile device 100 may be a battery-powered device and may comprise a battery interface 132 for receiving one or more rechargeable batteries 130. Battery interface 132 may be coupled to a regulator (not shown), which assists battery 130 in providing power V+ to mobile device 100. Although current technology makes use of a battery, future technologies such as micro fuel cells may provide power to mobile device 100. In some embodiments, mobile device 100 may be solar-powered.

Microprocessor 102, in addition to its operating system functions, enables execution of software applications on mobile device 100. A set of applications that control basic device operations, including data and voice communication applications, may be installed on mobile device 100 during its manufacture. Another application that may be loaded onto mobile device 100 is a personal information manager (PIM). A PIM has functionality to organize and manage data items of interest to a subscriber, such as, but not limited to, e-mail, calendar events, voice mails, appointments, and task items. A PIM application has the ability to send and receive data items via wireless network 200. PIM data items may be seamlessly integrated, synchronized, and updated via wireless network 200 with the mobile device subscriber's corresponding data items stored and/or associated with a host computer system. This functionality may create a mirrored host computer on mobile device 100 with respect to such items. This can be particularly advantageous where the host computer system is the mobile device subscriber's office computer system.

Additional applications may also be loaded onto mobile device 100 through network 200, auxiliary I/O subsystem 112, serial port 114, short-range communications subsystem 122, or any other suitable subsystem 124. This flexibility in application installation increases the functionality of mobile device 100 and may provide enhanced on-device functions, communication-related functions, or both. For example, secure communication applications may enable electronic commerce functions and other such financial transactions to be performed using mobile device 100.

Serial port 114 enables a subscriber to set preferences through an external device or software application and extends the capabilities of mobile device 100 by providing for information or software downloads to mobile device 100 other than through a wireless communication network. The alternate download path may, for example, be used to load an encryption key onto mobile device 100 through a direct and thus reliable and trusted connection to provide secure device communication.

Short-range communications subsystem 122 provides for communication between mobile device 100 and different systems or devices, without the use of network 200. For example, subsystem 122 may include an infrared device and associated circuits and components for short-range communication. Examples of short range communication include standards developed by the Infrared Data Association (IrDA), Bluetooth®, and the 802.11 family of standards (Wi-Fi®) developed by IEEE.

In use, a received signal such as a text message, an e-mail message, or web page download is processed by communication subsystem 104 and input to microprocessor 102. Microprocessor 102 then processes the received signal for output to display 110 or alternatively to auxiliary I/O subsystem 112. A subscriber may also compose data items, such as e-mail messages, for example, using keyboard 116 in conjunction with display 110 and possibly auxiliary I/O subsystem 112. Auxiliary subsystem 112 may include devices such as: a touch screen, mouse, track ball, optical trackpad, infrared fingerprint detector, or a roller wheel with dynamic button pressing capability. Keyboard 116 may comprise an alphanumeric keyboard and/or telephone-type keypad, for example. A composed item may be transmitted over network 200 through communication subsystem 104.

For voice communications, the overall operation of mobile device 100 may be substantially similar, except that the received signals may be processed and output to speaker 118, and signals for transmission may be generated by microphone 120. Alternative voice or audio I/O subsystems, such as a voice message recording subsystem, may also be implemented on mobile device 100. Although voice or audio signal output is accomplished primarily through speaker 118, display 110 may also be used to provide additional information such as the identity of a calling party, duration of a voice call, or other voice call related information.

Referring now to FIG. 2, a block diagram of the communication subsystem component 104 of FIG. 1 is shown. Communication subsystem 104 may comprise a receiver 150, a transmitter 152, one or more embedded or internal antenna elements 154, 156, Local Oscillators (LOs) 158, and a processing module such as a Digital Signal Processor (DSP) 160.

The particular design of communication subsystem 104 is dependent upon the network 200 in which mobile device 100 is intended to operate; thus, it should be understood that the design illustrated in FIG. 2 serves only as one example. Signals received by antenna 154 through network 200 are input to receiver 150, which may perform such common receiver functions as signal amplification, frequency down conversion, filtering, channel selection, and analog-to-digital (A/D) conversion. A/D conversion of a received signal allows more complex communication functions such as demodulation and decoding to be performed in DSP 160. In a similar manner, signals to be transmitted are processed, including modulation and encoding, by DSP 160. These DSP-processed signals are input to transmitter 152 for digital-to-analog (D/A) conversion, frequency up conversion, filtering, amplification and transmission over network 200 via antenna 156. DSP 160 not only processes communication signals, but also provides for receiver and transmitter control. For example, the gains applied to communication signals in receiver 150 and transmitter 152 may be adaptively controlled through automatic gain control algorithms implemented in DSP 160.

The wireless link between mobile device 100 and a network 200 may contain one or more different channels, typically different RF channels, and associated protocols used between mobile device 100 and network 200. A RF channel is generally a limited resource, typically due to limits in overall bandwidth and limited battery power of mobile device 100.

When mobile device 100 is fully operational, transmitter 152 may be typically keyed or turned on only when it is sending to network 200 and may otherwise be turned off to conserve resources. Similarly, receiver 150 may be periodically turned off to conserve power until it is needed to receive signals or information (if at all) during designated time periods.

Referring now to FIG. 3, a block diagram of a node of a wireless network is shown as 202. In practice, network 200 comprises one or more nodes 202. Mobile device 100 communicates with a node 202 within wireless network 200. In the example implementation of FIG. 3, node 202 is configured in accordance with GPRS and GSM technologies; however, in other embodiments, different standards may be implemented as discussed in more detail above. Node 202 includes a base station controller (BSC) 204 with an associated tower station 206, a Packet Control Unit (PCU) 208 added for GPRS support in GSM, a Mobile Switching Center (MSC) 210, a Home Location Register (HLR) 212, a Visitor Location Registry (VLR) 214, a Serving GPRS Support Node (SGSN) 216, a Gateway GPRS Support Node (GGSN) 218, and a Dynamic Host Configuration Protocol (DHCP) server 220. This list of components is not meant to be an exhaustive list of the components of every node 202 within a GSM/GPRS network, but rather a list of components that are commonly used in communications through network 200.

In a GSM network, MSC 210 is coupled to BSC 204 and to a landline network, such as a Public Switched Telephone Network (PSTN) 222 to satisfy circuit switched requirements. The connection through PCU 208, SGSN 216 and GGSN 218 to the public or private network (Internet) 224 (also referred to herein generally as a shared network infrastructure) represents the data path for GPRS capable mobile devices. In a GSM network extended with GPRS capabilities, BSC 204 also contains a Packet Control Unit (PCU) 208 that connects to SGSN 216 to control segmentation, radio channel allocation and to satisfy packet switched requirements. To track mobile device location and availability for both circuit switched and packet switched management, HLR 212 is shared between MSC 210 and SGSN 216. Access to VLR 214 is controlled by MSC 210.

Station 206 may be a fixed transceiver station. Station 206 and BSC 204 together may form the fixed transceiver equipment. The fixed transceiver equipment provides wireless network coverage for a particular coverage area commonly referred to as a "cell". The fixed transceiver equipment transmits communication signals to and receives communication signals from mobile devices within its cell via station 206. The fixed transceiver equipment normally performs such functions as modulation and possibly encoding and/or encryption of signals to be transmitted to the mobile device in accordance with particular, usually predetermined, communication protocols and parameters, under control of its controller. The fixed transceiver equipment similarly demodulates and possibly decodes and decrypts, if necessary, any communication signals received from mobile device 100 within its cell. Communication protocols and parameters may vary between different nodes. For example, one node may employ a different modulation scheme and operate at different frequencies than other nodes.

For all mobile devices 100 registered with a specific network, permanent configuration data such as a user profile may be stored in HLR 212. HLR 212 may also contain location information for each registered mobile device and can be queried to determine the current location of a mobile device. MSC 210 is responsible for a group of location areas and stores the data of the mobile devices currently in its area of responsibility in VLR 214. Further VLR 214 also contains information on mobile devices that are visiting other networks. The information in VLR 214 includes part of the permanent mobile device data transmitted from HLR 212 to VLR 214 for faster access. By moving additional information from a remote HLR 212 node to VLR 214, the amount of traffic between these nodes can be reduced so that voice and data services can be provided with faster response times while requiring less use of computing resources.

SGSN 216 and GGSN 218 are elements that may be added for GPRS support; namely packet switched data support, within GSM. SGSN 216 and MSC 210 have similar responsibilities within wireless network 200 by keeping track of the location of each mobile device 100. SGSN 216 also performs security functions and access control for data traffic on network 200. GGSN 218 provides internetworking connections with external packet switched networks and connects to one or more SGSNs 216 via an Internet Protocol (IP) backbone network operated within the network 200. During normal operations, a given mobile device 100 performs a "GPRS Attach" to acquire an IP address and to access data services. This normally is not present in circuit switched voice channels as Integrated Services Digital Network (ISDN) addresses may be generally used for routing incoming and outgoing calls. Currently, GPRS capable networks may use private, dynamically assigned IP addresses, thus requiring a DHCP server 220 connected to the GGSN 218. There are many mechanisms for dynamic IP assignment, including using a combination of a Remote Authentication Dial-In User Service (RADIUS) server and DHCP server, for example. Once the GPRS Attach is complete, a logical connection is established from a mobile device 100, through PCU 208, and SGSN 216 to an Access Point Node (APN) within GGSN 218, for example. The APN represents a logical end of an IP tunnel that can either access direct Internet compatible services or private network connections. The APN also represents a security mechanism for network 200, insofar as each mobile device 100 must be assigned to one or more APNs and mobile devices 100 cannot generally exchange data without first performing a GPRS Attach to an APN that it has been authorized to use. The APN may be considered to be similar to an Internet domain name such as "myconnection.wireless-.com".

Once the GPRS Attach is complete, a tunnel is created and all traffic is exchanged within standard IP packets using any protocol that can be supported in IP packets. This includes tunneling methods such as IP over IP as in the case with some IPSecurity (IPsec) connections used with Virtual Private Networks (VPN). These tunnels are also referred to as Packet Data Protocol (PDP) Contexts and there are a limited number of these available in the network 200. To maximize use of the PDP Contexts, network 200 will run an idle timer for each PDP Context to determine if there is a lack of activity. When a mobile device 100 is not using its PDP Context, the PDP Context can be deallocated and the IP address returned to the IP address pool managed by DHCP server 220.

Figure 4A:
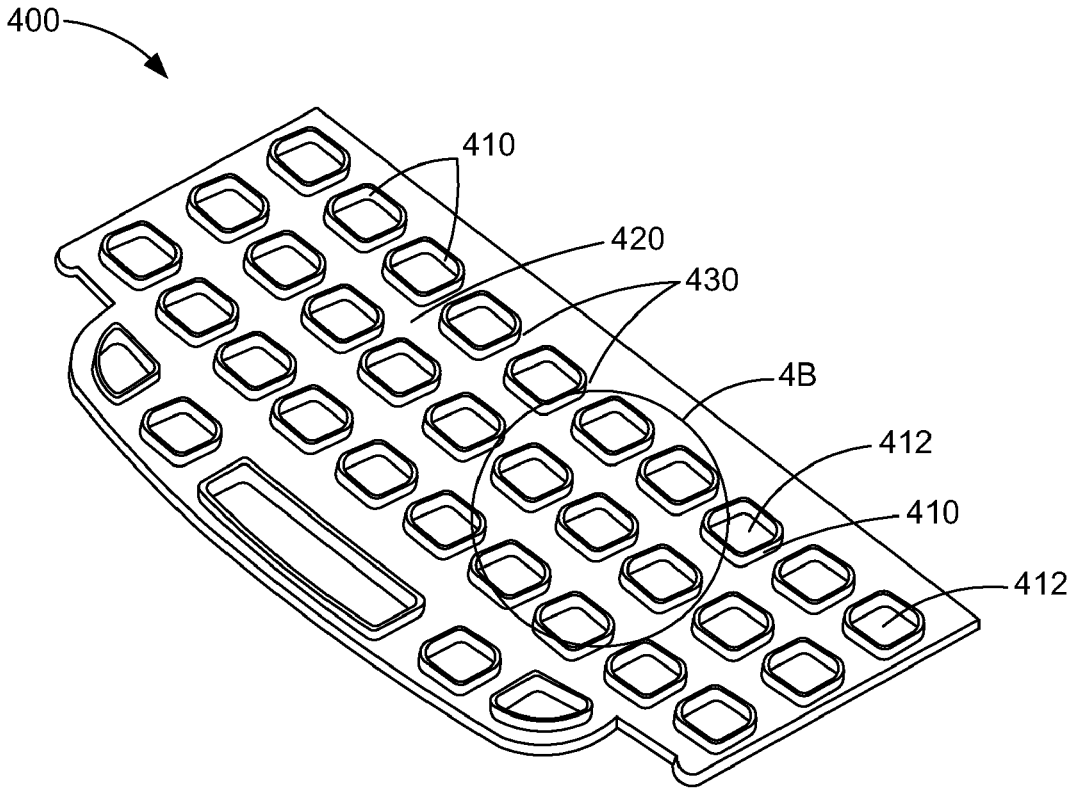
FIG. 4A is a perspective view of a deflection web according to an embodiment of the present invention.
Figure 4B:
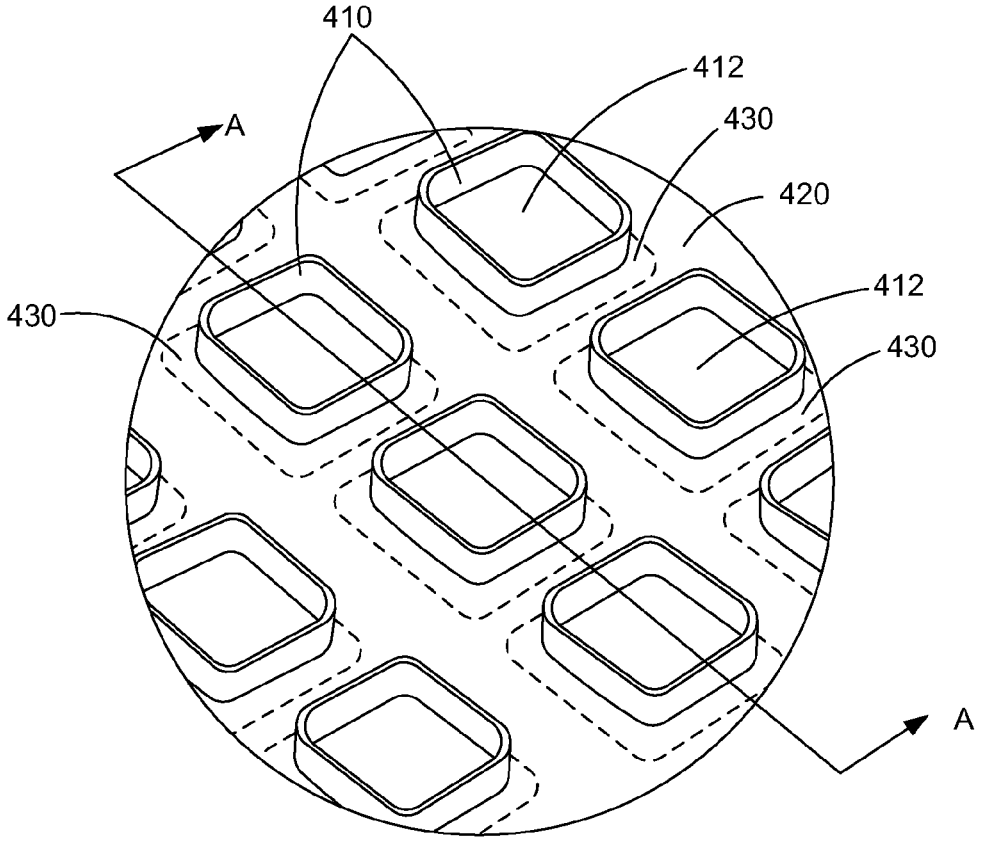
FIG. 4B is an enlargement of the portion of the deflection web of FIG. 4A contained within the circle 4B.

Referring now to FIGS. 4A and 4B, a deflection web according to an embodiment of the present invention is shown generally as 400. The deflection web 400 may be used as a component of a keypad assembly of a mobile device 100, such as the mobile device 100 described above. The interaction of the deflection web 400 with various components of a keypad assembly of a mobile device 100 will be described in more detail below in relation to FIGS. 6A and 6B.

With specific reference to FIG. 4A, the deflection web 400 may comprise a plurality of actuators 410 aligned in a planar arrangement and resiliently coupled together by a flexible membrane 420. The actuators 410 may correspond in number, shape, and configuration to the plurality of keys to be used therewith. The embodiment illustrated in FIG. 4A is configured to accommodate a full QWERTY keyboard. Other configurations may also exist to correspond to keyboards with different numbers of and arrangements of keys.

FIG. 4B is an enlargement of the portion 4B of the deflection web 400 circled in FIG. 4A. Each actuator 410 comprises a seat 412 for receiving a key of a keyboard 116. A portion of the flexible membrane 420 coupling the actuators 410 together comprises a flange 430 (represented by the area of the flexible membrane 420 around each actuator 410 within the surrounding dotted lines) that extends radially outwardly from the periphery of each actuator 410. In some embodiments, an upper surface 425 (FIG. 5A) of the flexible membrane 420 may not be coplanar with an upper surface 435 (FIG. 5A) of the flange 430 when the deflection web 400 is in a relaxed state (i.e. when the deflection web 400 is free of externally applied forces). Advantages of such a non-planar configuration will be discussed further below.

Figure 4C:
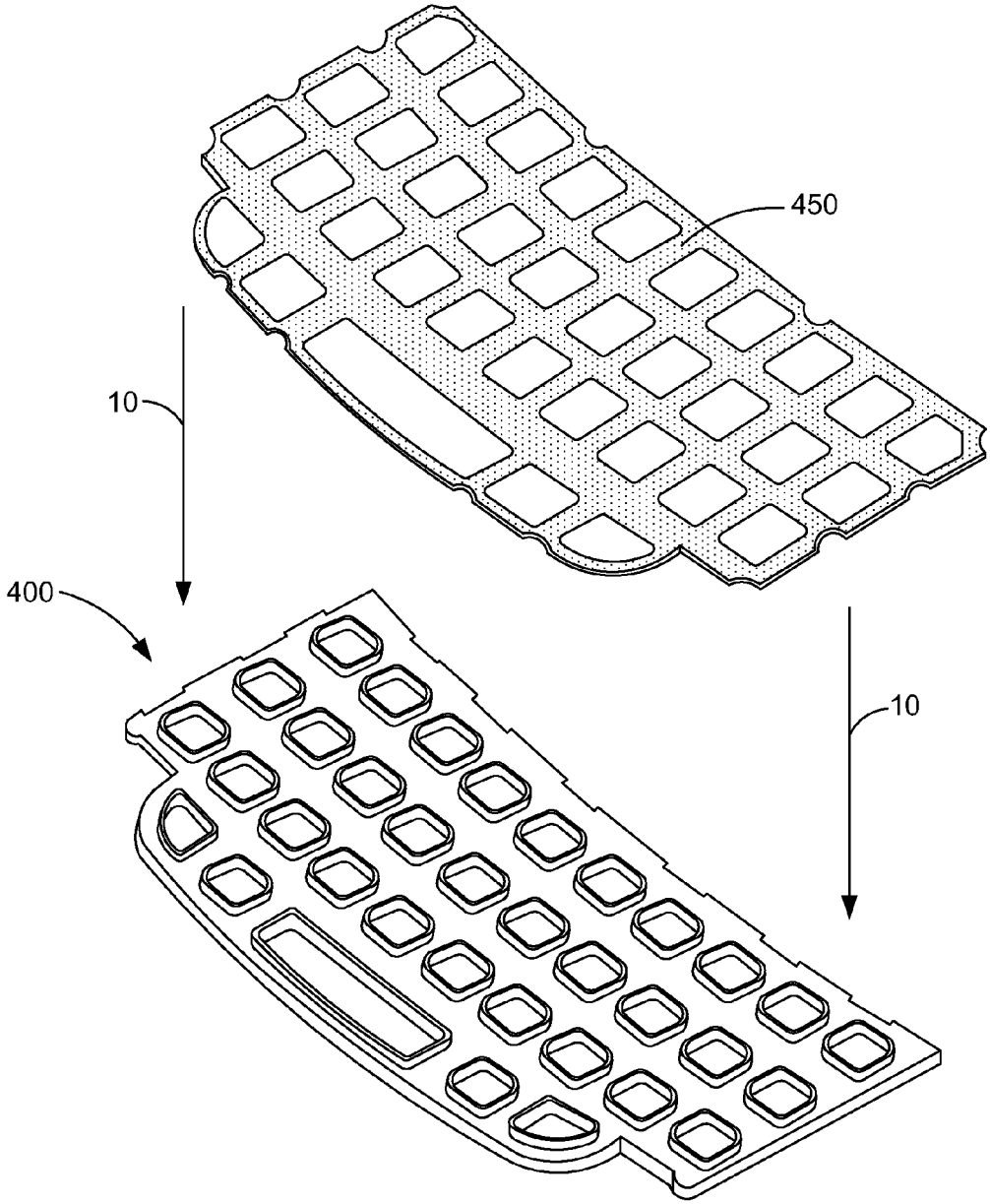
FIG. 4C is an exploded perspective view of the deflection web of FIG. 4A to which a light shielding layer is overlaid.

As will be discussed further below, a light shielding layer may be overlaid onto the deflection web 400 and/or provided between the plurality of keys and the deflection web 400 when assembled within a keypad assembly. Reference is briefly made to FIG. 4C, in which an example of a light shielding layer 450 is shown overlaid onto the deflection web 400 in the direction of arrows 10.

Figure 5A:
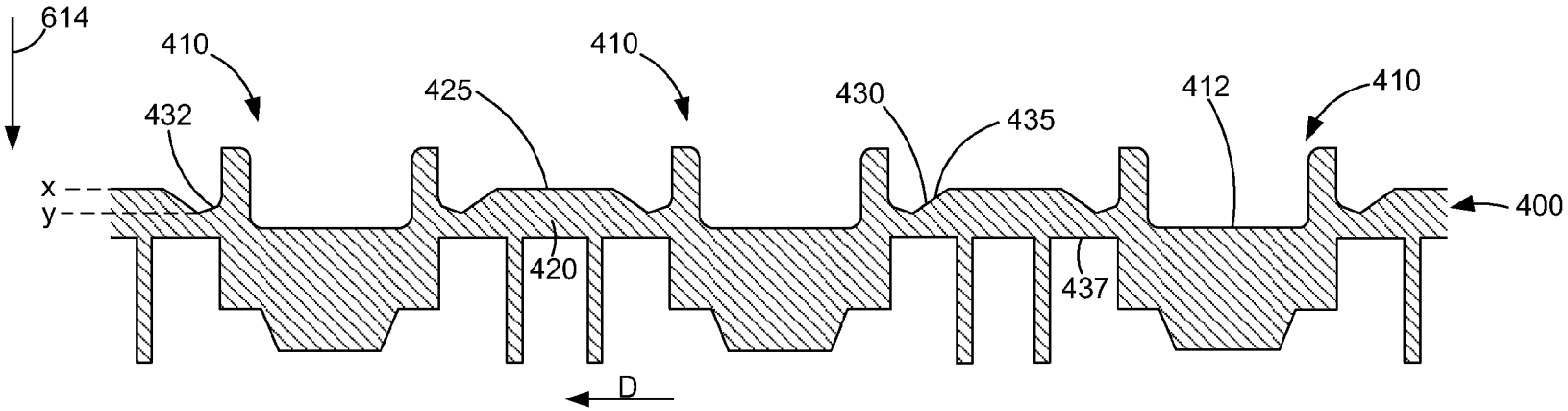
FIG. 5A is a section view of the deflection web of FIG. 4B along section line A-A and in the direction indicated.

Reference is now made to FIG. 5A, which illustrates a sectional view of the deflection web 400 along section line A-A of FIG. 4B. As illustrated, the thickness of the flange 430 of each actuator 410 (i.e. the distance between the upper surface 435 and a lower surface 437 of the flange 430) varies in a direction D from each actuator 410. The direction D may be a direction radially outward from the corresponding actuator 410. In the embodiment illustrated, the thickness of each flange 430 increases at a substantially constant rate for at least a portion of the flange 430 as the flange 430 extends outwardly away (in a direction D) from its corresponding actuator 410—this is due to the upper surface 435 of the flange 430 extending from the actuator 410 at an incline while the lower surface 437 of the flange 430 extends with substantially no incline (i.e. substantially horizontally) from the actuator 410. In other embodiments, the thickness of the flange 430 may increase or decrease at either an increasing or decreasing rate (or a combination thereof) as it extends outwardly from the actuator 410. As will be discussed further below, the thickness of the flange 430 may be varied in order to achieve desired pre-loading characteristics when the deflection web 400 experiences a deformation.

Figure 5B:
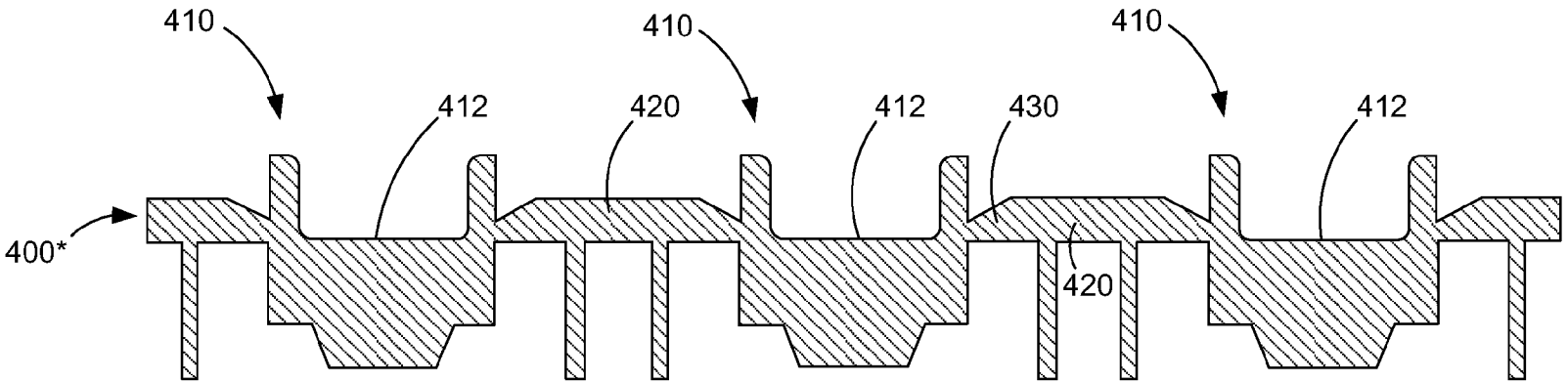
FIG. 5B is a section view of a deflection web without chamfers at the intersection of each flange and corresponding actuator, in accordance with the invention.

In operation, the repetitive forces sustained by the deflection web 400 from continuous depression of one or more of the keys may cause concentrated stress zones in the deflection web 400 where each flange 430 meets its corresponding actuator 410. In order to help alleviate the increased stress in these areas, the deflection web 400 may be provided with a chamfer 432 where each flange 430 and corresponding actuator 410 converge. A chamfer helps to alleviate stress at sharp edges of structures by effectively smoothing out the edge, making it more gradual. Such chamfers 432 can be observed on the deflection web 400 of FIG. 5A. FIG. 5B illustrates an alternate embodiment of a deflection web 400* having corresponding parts but lacking described chamfers.

The deflection web 400 (i.e. the actuators and the flexible membrane 420) may comprise a flexible material (e.g. an elastomer or rubber material such as silicon rubber). The use of an elastomeric material for the deflection web 400 typically allows the web 400 to deform in response to an externally applied force and return to its natural orientation once the force is released. The web 400 may tend to return to its natural orientation (or relaxed state) due to pre-load or tension forces produced within the web material when deformed. As an example, depression of an actuator 410 of the deflection web 400 may induce a tension (or pre-load) force in the corresponding flange 430, which is exerted on the actuator 410, to counteract the depression.

Figure 6A:
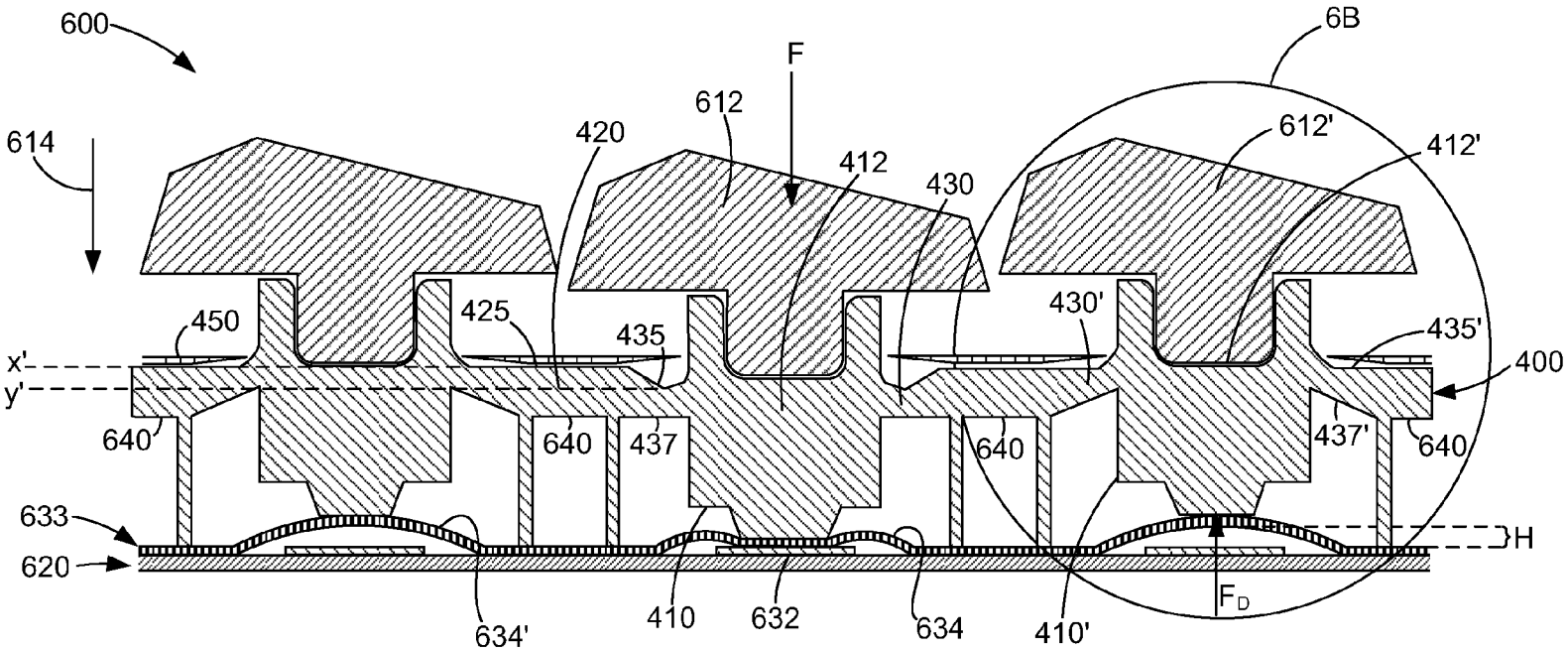
FIG. 6A is a section view of a keypad assembly similar to the section view of the deflection web shown in FIG. 5A.

Reference is now made to FIG. 6A, which illustrates the sectional view of FIG. 5A showing the interaction of the deflection web 400 with various components of a keypad assembly 600. In addition to the deflection web 400, the keypad assembly 600 may comprise a plurality of keys 612, 612' and a keypad base 620. As illustrated, when assembled in the keypad assembly 600, the deflection web 400 may be provided between the keys 612, 612' of a keypad assembly 600 and the base 620 of the keypad assembly 600. Additionally (and as mentioned above), the keypad assembly 600 may comprise a light shielding layer 450 superimposed over the deflection web 400.

In FIG. 6A, the key 612' is shown in a first undepressed position, whereas the key 612 is shown in the depressed position as a result of an externally applied force F applied in a key depression direction 614 (i.e. towards a corresponding switch 632). The force F may be applied, for example, by a user of the keypad assembly 600 while composing a message on a mobile device 100.

The keypad base 620 may comprise a printed circuit board assembly having a plurality of switches 632 (one switch 632 provided for and corresponding to each key 612 and actuator 410). The base 620 of the keypad assembly 600 may also comprise an overlay 633 having a plurality of domes 634, 634', each covering a corresponding switch 632 of the base 620. The deflection web 400 is anchored to the base 620 at selected locations 640 between the flanges 430, 430' in order to facilitate pre-loading of the flanges in response to a displacement of the corresponding actuator 410, 410' relative to the base 620. Anchoring of the deflection web 400 to the base 620 may be accomplished, for example, by co-molding the portions of the web 400 between each flange 430, 430' to a frame (e.g. made of a hard plastic) and affixing the frame to the base 620. Alternatively, the web 400 may be affixed to a plurality of pins (not shown), which penetrate the web 400 between some or all of the flanges 430, 430' and attach to the base 620. When the deflection web 400 is anchored to the base 620, each actuator 410, 410' aligns with a switch 632, and the dome 634 covering each switch 632 exerts a force $F_D$ (sometimes referred to as the dome peak force, and further discussed below with reference to FIG. 6B), on each actuator 410, 410', causing a displacement of each actuator 410, 410' into the first undepressed position. The displacement of the actuators 410, 410', in combination with the anchoring of the deflection web 400 to the base 620, causes the corresponding flanges 430, 430' to stretch. As will be discussed in further detail below, when a key 612' is in the undepressed position, the stretched flange 430' exerts a pre-load force T on the corresponding actuator 410 partially in the key depression direction 614.

When a key 612 is depressed, the corresponding actuator 410 may make contact with the corresponding switch 632 (either directly or through an intermediary element such as the dome 634, 634' of the overlay 633), signaling the depression of the key 612. Each switch 632 may comprise a pressure sensor or, alternatively, may comprise an electrical contact for contacting a complementary electrical contact (not shown) coupled to the underside of each dome 634, 634'.

As discussed above, when the web 400 is anchored to the keypad base 620, the dome 634' displaces the actuator 410' from its relaxed state (as illustrated in FIG. 5A, wherein the upper surface 435 of the flanges 430 extends from the actuators 410 at an incline) such that when the key 612' is in the first undepressed position, the upper surface 435' of the flange 430' is substantially flat and extends from the actuator 410' at substantially no incline (i.e. substantially horizontally). Accordingly, the flanges 430, 430' of the deflection web 400 may be designed taking into account the specifications of the overlay 633 that is to be used in the keypad assembly 600. Where the overlay 633 comprises a plurality of domes 634, the travel of the flanges 430, 430' in the key depression direction 614 may be designed to be approximately equal to the height H of the domes 634, 634' of the overlay 633 when the domes 634, 634' are undepressed (or uncrushed). In other words, the difference between the position x' of the upper surface 435' of the flange 430' proximate the actuator 410' when the key 612' is undepressed, and the position y' of the lowest point of the upper surface 435 of the flange 430 when the key 612 is depressed is roughly equal to the approximate height H of an uncrushed dome 634' less the thickness of the dome material. In some embodiments, the approximate height H of an uncrushed dome 634' is also roughly equal to the difference between the position x (FIG. 5A) of the upper surface 425 of the flexible membrane 420 (between the flanges 435), and the position y (FIG. 5A) of the lowest point of the upper surface 435 of the flange 430 proximate its corresponding actuator 410. It will be appreciated that the distance between position x and position y (FIG. 5A) corresponds approximately to the upward displacement to an actuator 410 required to cause the upper surface 435 of the corresponding flange 430 to lie substantially flat as it extends from the actuator 410. When the flanges 430, 430' lie substantially flat as they extend from the actuators 410, 410', the top surface of the deflection web 400 through the interstices of the actuators 410, 410' (i.e. the combined top surface 435, 435' of the flanges 430, 430' and top surface 425 of the flexible membrane 420) may also be substantially flat.

Designing the flanges 430, 430' of the deflection web 400 to be substantially flat when the keypad assembly 600 is assembled and the actuators 410, 410' are in the undepressed position may help reduce the amount of light leakage from the keypad assembly 600. As illustrated in FIG. 6A, where the light shielding layer 450 is overlaid on the deflection web 400, the light shielding layer 450 may be unaffected by movement of the actuators 410, 410' between the undepressed position and the depressed position. Consequently, cracking of the light shielding layer 450 (which may cause increased light leakage) resulting from localized deformation may be reduced or avoided.

Further, preventing deformation of the light shielding layer 450 may help to provide a user of the keypad assembly 600 with a better tactile feel when depressing the keys 410, 410' by helping to ensure that external forces are not exerted on the flange 430' by the light shielding layer 450 when the actuator 410' is in the undepressed position. The forces typically exerted on deflection webs by light shielding layers (from a tension force present within the light shielding layer as a result of its deformation) tend to be uneven and unpredictable. By reducing and/or eliminating such unpredictable forces exerted on the deflection web 400, keypad assembly 600 designers may be better able to control the tactile feel provided to a user of the keypad assembly 600.

Figure 6B:
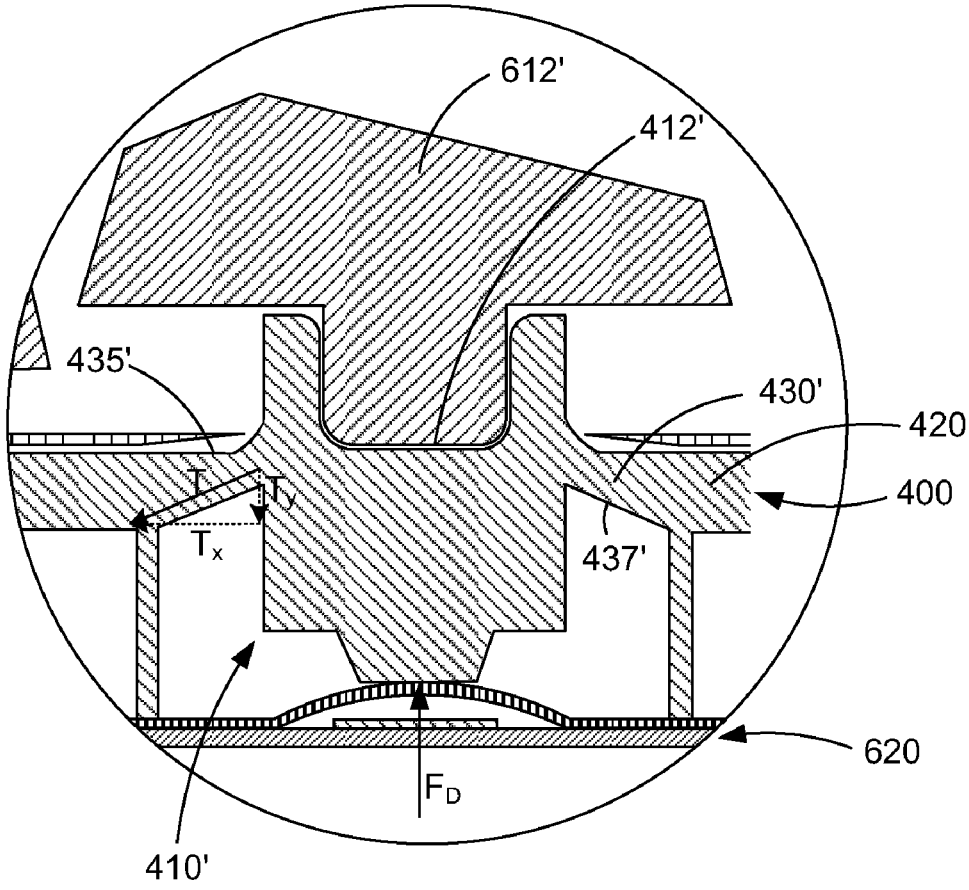
FIG. 6B is an enlargement of the portion of the keypad assembly of FIG. 6A within the circle 6B.

Reference is now made briefly to FIG. 6B, which shows an enlargement of the portion 6B of the keypad assembly 600 circled in FIG. 6A and more clearly illustrates the pre-load force acting on the actuators 410' when the actuators 410' (and keys 612') are in the first undepressed position. As previously discussed, in the absence of any externally applied forces to a key 612' (e.g. from a user of the keypad assembly 600), the actuator 410' is in the first undepressed position. In this position, the actuator 410' is displaced from its relaxed state (illustrated in FIG. 5A) by the dome 634' with which it is in contact. A tension (or pre-load) force T is induced within the flange 430' proximate its lower surface 437' as a result of deformation of the web. It will be appreciated by those skilled in the art that although a single tension force T is illustrated for simplicity, the tension force T may be exerted substantially evenly around the actuator 410'. The tension force T may be broken down into a first component $T_x$, which acts in a direction substantially parallel to the base 620 and extending radially outwardly from the actuator 410', and a second component $T_y$, which acts in a direction perpendicular to $T_x$ (i.e. toward the base 620).

Accordingly, when the actuator 410' is in the first undepressed position, the forces acting on the actuator 410' include $F_D$, $T_x$, and $T_y$ (as discussed above, the actuator may be free from forces exerted by the light shielding layer 450). Therefore, in order to cause a depression of the key 612' (and corresponding actuator 410'), the force F (FIG. 6A) applied to the key 612' must be greater than $(F_D-T_y)$. It will be appreciated that the domes 634, 634' must comprise a material strong enough to exert a force $F_D$ on the actuator 410' that is greater than the component $T_y$ of the tension force T in order for the dome 634' to cause the actuator 410' to return to the first undepressed position when the force F is released (e.g. the key 612' is released by a user of the keypad assembly 600).

The tension (or pre-load) force T may vary with the thickness of the flange 430, 430' and with the composition of the flange 430, 430' and the web 400. Therefore, the thickness of the flange 430, 430' (and/or the material from which the flange 430, 430' and the web 400 are made) may be appropriately selected to provide the pre-load forces required to achieve the desired tactile feel (by controlling the magnitude of the force F required to depress the keys 612, 612'). In some embodiments, the flange may be designed such that the component $T_y$ of the pre-load force T is between ten and twenty-five percent of the dome peak force $F_D$.

Figure 7:
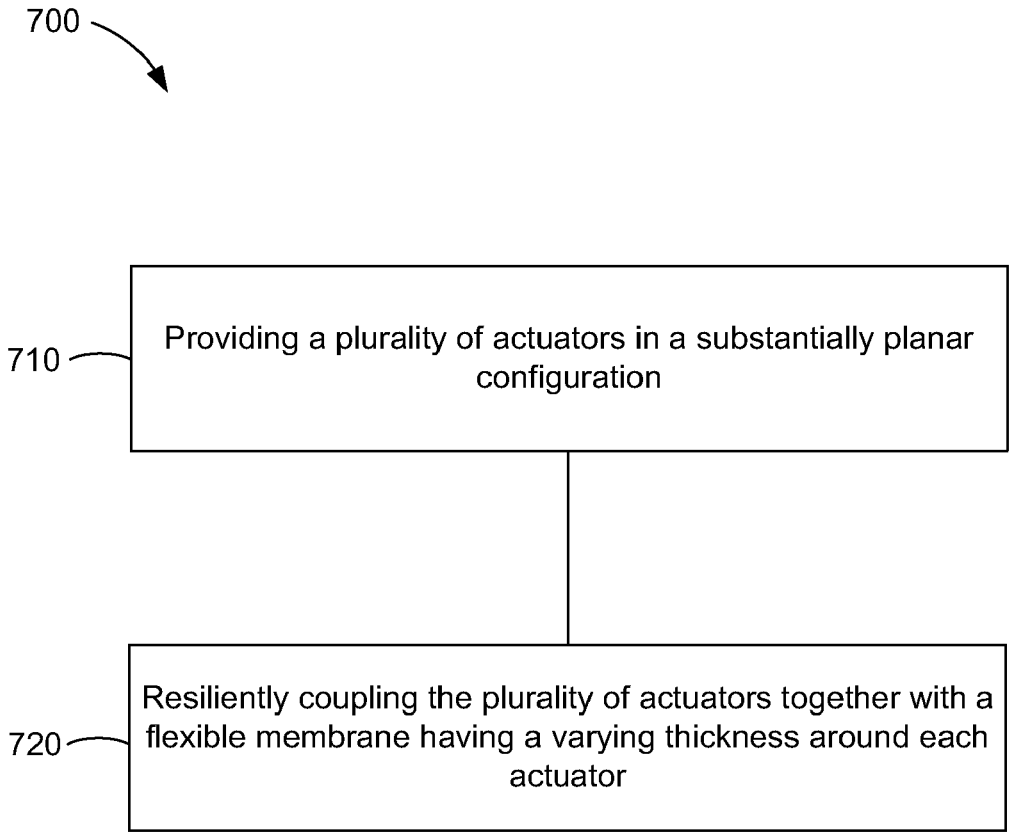
FIG. 7 is a logical flow diagram of a method for creating a deflection web according to an embodiment of the present invention.

With reference to the logical flow diagram of FIG. 7, a method for creating a deflection web 400 for a keypad assembly 600 (referred to generally as 700) will now be discussed. A plurality of actuators 410, 410' are provided in a substantially planar configuration at Block 710. At Block 720, the plurality of actuators 410, 410' are resiliently coupled together with a flexible membrane 420. For each actuator 410, 410', the flexible membrane 420 comprises a surrounding portion (i.e. an outwardly radially extending flange 430, 430') the thickness of which varies in a direction from the corresponding actuator 410, 410'. The deflection web 400 may be molded using an appropriately configured mold, or alternatively, may be created having separate flexible membrane 420 and actuator 410, 410' components. Further, in some embodiments, a portion of the deflection web 400 (e.g. the portion not encompassing the actuators 410, 410' or the flanges 435, 435') may be co-molded to a frame. The frame may be made of hard plastic, for example, and may be injection molded.

As discussed above, the flexible membrane 420 and actuators 410, 410' may comprise a suitably resilient material, such as an elastomeric material. Further, the thickness of the flange 430 may be appropriately varied in order to induce the desired pre-load force T when the web 400 undergoes a deformation.

Figure 8:
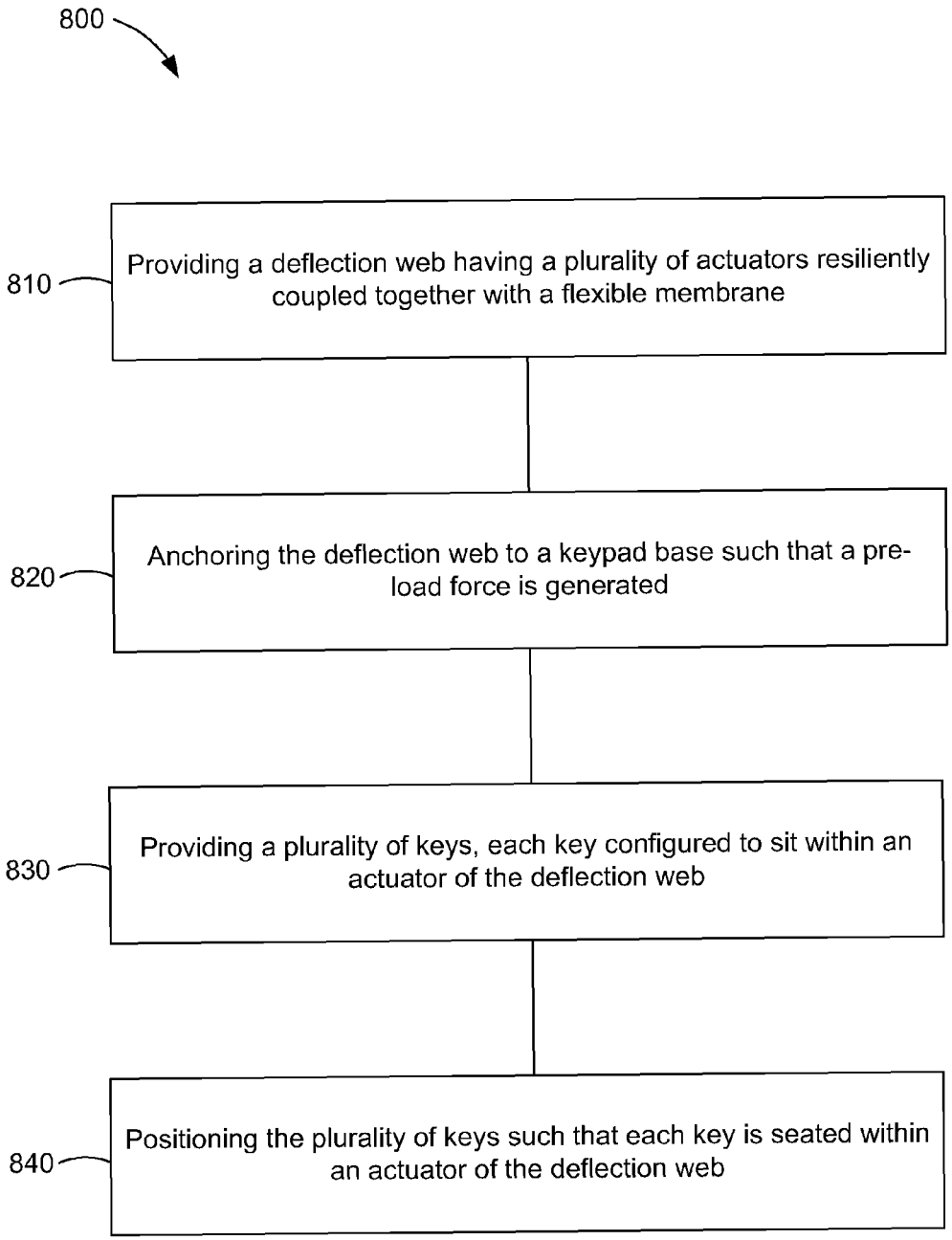
FIG. 8 is a logical flow diagram of a method for assembling a keypad assembly according to an embodiment of the present invention.

Referring now to the logical flow diagram of FIG. 8, a method for assembling a keypad assembly 600 (referred to generally as 800) will now be discussed. A deflection web 400 having a plurality of actuators resiliently coupled together is provided at Block 810. The actuators may be coupled together using a flexible membrane 420 and the actuators and flexible membrane 420 may comprise an elastomeric material in order to provide suitable pre-loading characteristics when the web 400 is deformed.

At Block 820, the deflection web 400 may be anchored to a keypad base 620 such that a pre-load force T is generated in a flange 430, 430' portion of the flexible membrane 420 surrounding each actuator 410, 410'. The deflection web 400 may be anchored using known techniques including, but not limited to, adhesive bonding and riveting. The keypad base 620 may comprise a plurality of switches 632 and an overlay 633 with a plurality of domes 634, 634' (a dome 634, 634' corresponding to, and covering, each switch 632). The domes 634, 634' of the overlay 633 may cause the actuator 410 to deform and settle in the first undepressed position (as described above). While in the undepressed position, the upper surface 435 of the flange may be substantially flat proximate its corresponding actuator 410.

At Block 830, a plurality of keys 612, 612' is provided. Each key 612, 612' is configured to sit within an actuator 410 of the deflection web 400. At Block 840, the plurality of keys 612, 612' are positioned such that each key 612, 612' sits in a seat 412, 412' of an actuator 410, 410' of the deflection web 400. Optionally, the keys 612, 612' may be coupled to the actuators 410, 410' (e.g. using an adhesive) in order to ensure that the proper positioning of the keys 612, 612' within the actuators 410, 410' is maintained.

The embodiments of keypad assemblies described herein may allow for desired pre-loading of the flange portions of the deflection web of the assembly. Accordingly, a user of the assemblies may experience a greater tactile feel and response when pressing keys.

The steps of a method in accordance with any of the embodiments described herein may not be required to be performed in any particular order, whether or not such steps are described in the claims or otherwise in numbered or lettered paragraphs.

Various embodiments of a keypad assembly were described as having a plurality of keys. Similarly, various embodiments of a deflection web for use in a keypad assembly were described for accommodating a plurality of keys. Those of ordinary skill in the art will appreciate that the embodiments described above may be modified to accommodate a single key.

The present keypad assembly has been described with regard to a number of embodiments. However, it will be understood by persons skilled in the art that other variants and modifications may be made without departing from the scope of the disclosure as defined in the claims appended hereto.

The invention claimed is:

1. A keypad assembly comprising:

(a) a plurality of keys;

(b) a deflection web comprising a plurality of actuators resiliently coupled together by a flexible membrane, wherein each actuator corresponds to a key;

(c) wherein for each actuator, the flexible membrane comprises a corresponding radially outwardly extending flange; and (d) wherein a thickness of the flange varies in a direction from the corresponding actuator.

2. The keypad assembly of claim 1, wherein a lower surface of the flange and an upper surface of the flange are non-parallel.

3. The keypad assembly of claim 1, wherein when a key is in a first undepressed position, the corresponding flange exerts a pre-load force on the corresponding actuator.

4. The keypad assembly of claim 3, wherein a component of the pre-load force is exerted in a key depression direction.

5. The keypad assembly of claim 1, further comprising a keypad base having a plurality of switches, wherein each switch corresponds to one of the plurality of keys.

6. The keypad assembly of claim 5, further comprising an overlay superimposed on the keypad base, the overlay having a dome corresponding to each switch.

7. The keypad assembly of claim 6, wherein when one of the plurality of keys is in a first undepressed position, the corresponding actuator is displaced by a height of the corresponding dome.

8. The keypad assembly of claim 7, wherein when the key is in the first undepressed position, an upper surface of the corresponding flange is substantially flat proximate the corresponding actuator.

9. The keypad assembly of claim 1, wherein the thickness of the flange increases as the flange extends in the direction from the corresponding actuator.

10. The keypad assembly of claim 1, wherein the assembly is configured for use in a mobile device.

11. A deflection web for a keypad assembly, the deflection web comprising:

(a) a plurality of actuators;

(b) a flexible membrane resiliently coupling each of the actuators together;

(c) wherein for each actuator, the flexible membrane comprises a corresponding radially outwardly extending flange; and (d) wherein a thickness of the flange varies in a direction from the corresponding actuator.

12. The deflection web of claim 11, wherein when each actuator is depressed, the corresponding flange exerts a force on the actuator to counteract the depression.

13. The deflection web of claim 11, further comprising a chamfer at an intersection of each flange and corresponding actuator.

14. The deflection web of claim 11, wherein the flexible membrane comprises an elastomeric material.

15. The deflection web of claim 11, wherein each actuator is configured to receive a key of the keypad assembly.

16. The deflection web of claim 11, further configured for anchoring to a keypad base.

17. The deflection web of claim 16, wherein when the deflection web is anchored to the keypad base, each actuator is depressible from a first undepressed position wherein the flexible membrane is substantially planar between each of the actuators.

18. The deflection web of claim 11, further configured for use in a keypad assembly having a plurality of keys and a plurality of switches and corresponding domes, wherein travel of the flange in a key depression direction is approximately equal to a height of one of the plurality of domes.

19. A method for creating a deflection web for a keypad assembly, the method comprising:

(a) providing a plurality of actuators in a substantially planar configuration; and (b) providing a flexible membrane resiliently coupling the plurality of actuators together, wherein for each actuator, the flexible membrane comprises a corresponding radially outwardly extending flange, and wherein a thickness of the flange varies in a direction from the corresponding actuator.

20. The method of claim 19, further comprising co-molding a portion of the deflection web to a frame.

* * * * *